US006789336B2

(12) United States Patent
Collins et al.

(10) Patent No.: US 6,789,336 B2
(45) Date of Patent: Sep. 14, 2004

(54) LATERALLY ADJUSTABLE, LOW PROFILE TRENCH-DIGGING MACHINE

(76) Inventors: Stanley Stewart Collins, 1980 Liberty Rd., Greenfield, TN (US) 38230; Michael Lewis Collins, 232 Judy La., Dresden, TN (US) 38225

( * ) Notice: Subject to any disclaimer, the term of this patent is extended or adjusted under 35 U.S.C. 154(b) by 0 days.

(21) Appl. No.: 10/010,794

(22) Filed: Nov. 13, 2001

(65) Prior Publication Data

US 2002/0116844 A1 Aug. 29, 2002

Related U.S. Application Data

(60) Provisional application No. 60/247,125, filed on Nov. 10, 2000.

(51) Int. Cl.[7] ..... E02F 5/04
(52) U.S. Cl. ..... 37/352
(58) Field of Search ..... 37/189, 462, 464, 37/347, 352, 403, 348, 355

(56) References Cited

U.S. PATENT DOCUMENTS 558,683 A * 4/1896 Girouard ..... 37/360
3,266,179 A * 8/1966 Golden ..... 37/355
3,577,664 A * 5/1971 Sing et al. ..... 37/300
3,659,364 A * 5/1972 Wilson ..... 37/348
4,756,259 A * 7/1988 Korenek ..... 111/101
4,941,786 A * 7/1990 Steinbock
4,987,689 A * 1/1991 Kaczmarski et al. ..... 37/195
5,189,819 A * 3/1993 Holloway et al. ..... 37/357
5,247,743 A * 9/1993 Holloway et al. ..... 37/355
5,606,809 A * 3/1997 Allen ..... 37/443
6,249,993 B1 * 6/2001 Armstrong et al. ..... 37/361
6,286,905 B1 * 9/2001 Kimura et al. ..... 299/39.3
6,349,488 B1 * 2/2002 Mason ..... 37/94

* cited by examiner

*Primary Examiner*—Thomas B. Will
*Assistant Examiner*—Alicia Torres
(74) *Attorney, Agent, or Firm*—Alston & Bird LLP

(57) ABSTRACT

A trench-digging machine is provided that includes a digging implement capable of being laterally offset beyond the bounds of the transport machine, thereby enabling the trench-digging machine to dig trenches that are laterally offset from the transport machine. The trench-digging machine also generally includes an attachment plate and frame to operably connect the digging implement to the transport machine. The attachment plate may be disposed at an angle offset from vertical such that the attachment plate faces downwardly. As such, the frame and, in turn, the digging implement may be operably connected to the transport machine at a position closer to the ground, thereby reducing the clearance required for access by the digging implement.

13 Claims, 9 Drawing Sheets

LATERALLY ADJUSTABLE, LOW PROFILE TRENCH-DIGGING MACHINE

CROSS-REFERENCE TO RELATED APPLICATIONS

The present application claims priority from U.S. provisional patent application Ser. No. 60/247,125, entitled: LATERALLY ADJUSTABLE, LOW PROFILE TRENCHDIGGING MACHINE, filed on Nov. 10, 2000, the contents of which are hereby incorporated by reference herein.

FIELD OF THE INVENTION

The present invention, in general, relates to trench-digging implements, and more particularly to a machine for digging a trench under or adjacent to an existing structure that is not readily accessible.

BACKGROUND OF THE INVENTION

Most permanent building structures require a solid foundation between the structure and the earth to support the weight of the structure. The foundation distributes and supports the load of the building and prevents the building from settling unevenly or sinking. Foundations are typically created by digging trenches around the future perimeter of a building structure. These trenches are then filled with concrete, which may be reinforced with steel, to create footings. The building is then built on these footings, with the footings supporting the load bearing walls and outer exterior of the building.

Formation of the footings for a building structure can be a large expenditure. Specifically, most structures require fairly wide and deep footings for support of the buildings. Digging the trenches manually with a shovel to form these footings can be labor intensive and a slow process.

To remedy these problems, power-driven machinery has been developed to replace manual labor for digging trenches. For example, one type of trench-digging machinery has been developed to dig or cut a trench in the ground using a chain saw configuration. These trench-digging machines typically include a digging implement containing a boom that supports a large chain containing teeth similar to a chain saw. When the chain is rotated, the teeth connected to the chain dig into the earth, thereby creating a trench. The digging implement is typically connected to a transport machine that supports and moves the digging implement into place for digging. The transport machine also typically includes a power source, such as a power take off shaft (PTO), chain and sprocket arrangement, or hydraulic pump and motor system, that causes the chain to rotate, thereby digging the trench.

An important limitation of many conventional trench-digging machines, however, is that they are typically not designed to dig under existing structures or to dig trenches in locations adjacent to an existing structure. Specifically, many trench-digging machines are configured such that the digging implement is connected to the rear of the transport vehicle in a position either at or near the centerline of the transport vehicle. As such, for the trench-digging machine to dig a trench, the transport vehicle must strattle the position where the trench is to be dug. If the trench is to be dug under an existing structure, however, the height of the transport vehicle may not provide proper clearance under the existing structure to properly position the digging implement for digging the trench. Similarly, if the trench is to be dug adjacent to an existing structure, the width of the transport vehicle may also prohibit placement of the digging implement adjacent to the existing structure.

SUMMARY OF THE INVENTION

An improved trench-digging machine is provided in accordance with the various embodiments of the present invention. According to one aspect of the present invention, a trench-digging machine is provided in which the digging implement is capable of being laterally offset beyond the lateral bounds of the transport machine, thereby enabling the trench-digging machine to dig trenches that are laterally displaced from the transport machine and are not merely located immediately behind the transport machine. According to another aspect of the present invention, an attachment plate and frame are provided that permit the digging implement of the trench-digging machine to be operably connected to the transport machine at a position closer to the ground, thereby reducing the clearance required for access by the digging implement. As such, the trench-digging machine of the present invention is capable of digging trenches in locations that were difficult, if not impossible, for conventional trench-digging machines to access. In this regard, the trench-digging machine of the present invention is advantageously adapted to dig trenches under existing structures.

The trench-digging machine includes a frame operably connected to a transport machine and a digging implement connected to the frame for digging a trench. As a frame of reference, the transport machine generally defines a lengthwise extending axis. In addition, the transport machine typically extends widthwise between a pair of lateral bounding planes that define the lateral extent of the transport machine. According to one advantageous embodiment, the frame is connected to the transport machine such that a center line of the digging implement is capable of being laterally offset from the lengthwise extending axis defined by the transport machine to a position beyond the respective lateral bounding plane of the transport machine. As such, the digging implement may be placed under an existing structure, even though the transport machine cannot similarly be positioned under the structure. Thus, the trench-digging machine of this embodiment is capable of digging trenches in locations otherwise inaccessible to a conventional trench-digging machine that extends immediately rearward of a transport machine.

In addition to the frame and the digging implement, the trench-digging machine of another embodiment includes an attachment plate for operable connection to the transport machine. Thus, the frame may be connected to the attachment plate in order to be operably connected to the transport machine. Relative to a vertical axis defined by the transport machine, the attachment plate of this embodiment is oriented at an angle $\alpha$ offset from vertical such that the attachment plate faces downwardly. In order to mate with the attachment plate, the frame may be configured to extend between a first face that is connected to the attachment plate and oriented at the same angle offset $\alpha$ from vertical as the attachment plate and an opposed second face having a vertical orientation. Thus, the digging implement may be connected to the second face of the frame so as to be connected to a surface having the desired vertical orientation. However, by operably connecting the frame to the transport machine by mean of an attachment plate that faces downwardly, the digging implement is connected to the frame at a position closer to the ground. As a result, the trench-digging machine of this embodiment requires less clearance so as to effectively reduce the distance by which a structure must be raised above the ground in order to permit the trench to be dug thereunder.

In one embodiment, the first face of the frame includes a pair of widthwise extending rails and at least one strut extending between the pair of rails to provide strength and rigidity. The attachment plate may therefore be connected to the at least one strut. As a result, the at least one strut of the frame also preferably extends to the same angle offset $\alpha$ from vertical as the attachment plate. By extending at an angle from vertical, the strut is generally somewhat longer than conventional vertical struts, thereby advantageously increasing the strength of the frame.

The attachment plate may be capable of connecting the frame to the transport machine at a plurality of positions, typically a plurality of positions laterally offset by different distances from the lengthwise extending axis defined by the transport machine. According to this embodiment, the center line of the digging implement carried by the frame is therefore adjustable with respect to the lengthwise extending axis of the transport machine by connecting the frame to the transport machine at different predetermined positions. Thus, the digging implement may be extended laterally beyond the transport machine during digging operations under a structure. However, the digging implement may be repositioned so as to extend rearward behind the transport machine, either for digging operations or for transportation of the transport machine.

BRIEF DESCRIPTION OF THE DRAWINGS

Figure 1:
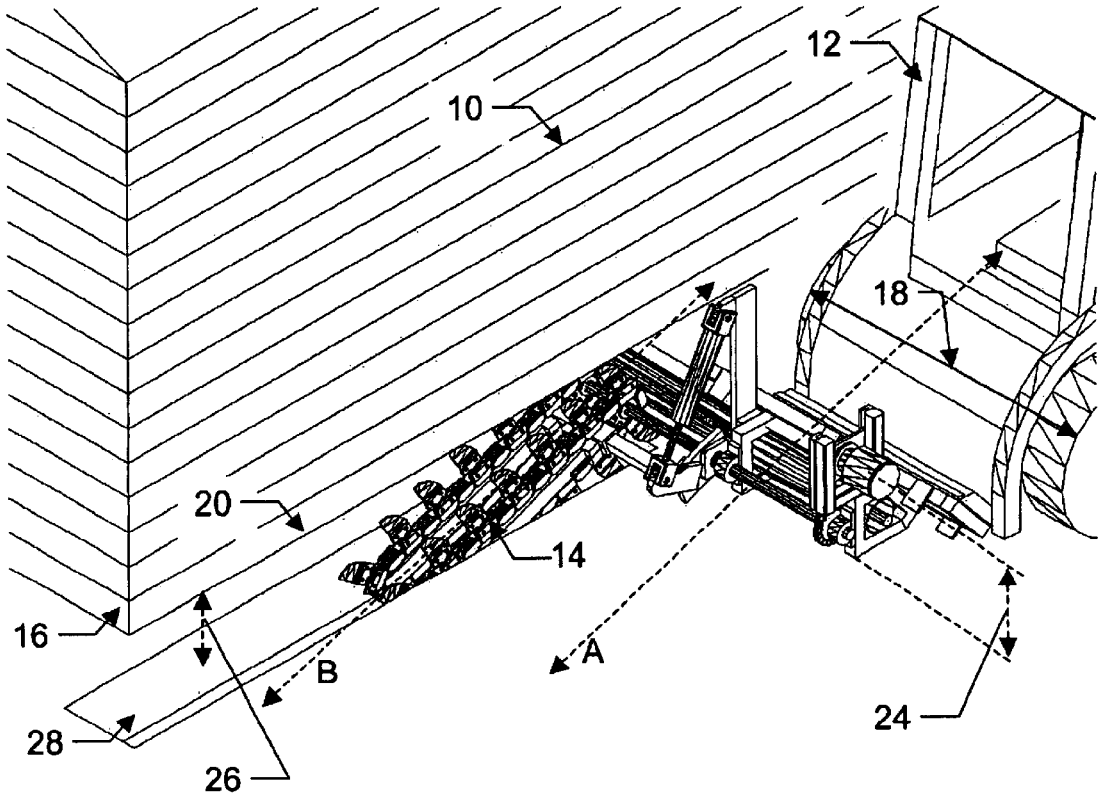

Having thus described the invention in general terms, reference will now be made to the accompanying drawings, which are not necessarily drawn to scale, and wherein:

FIG. 1 is a perspective view of a trench-digging machine according to one embodiment of the present invention positioned under an existing structure for digging a trench under the existing structure.

Figure 2:
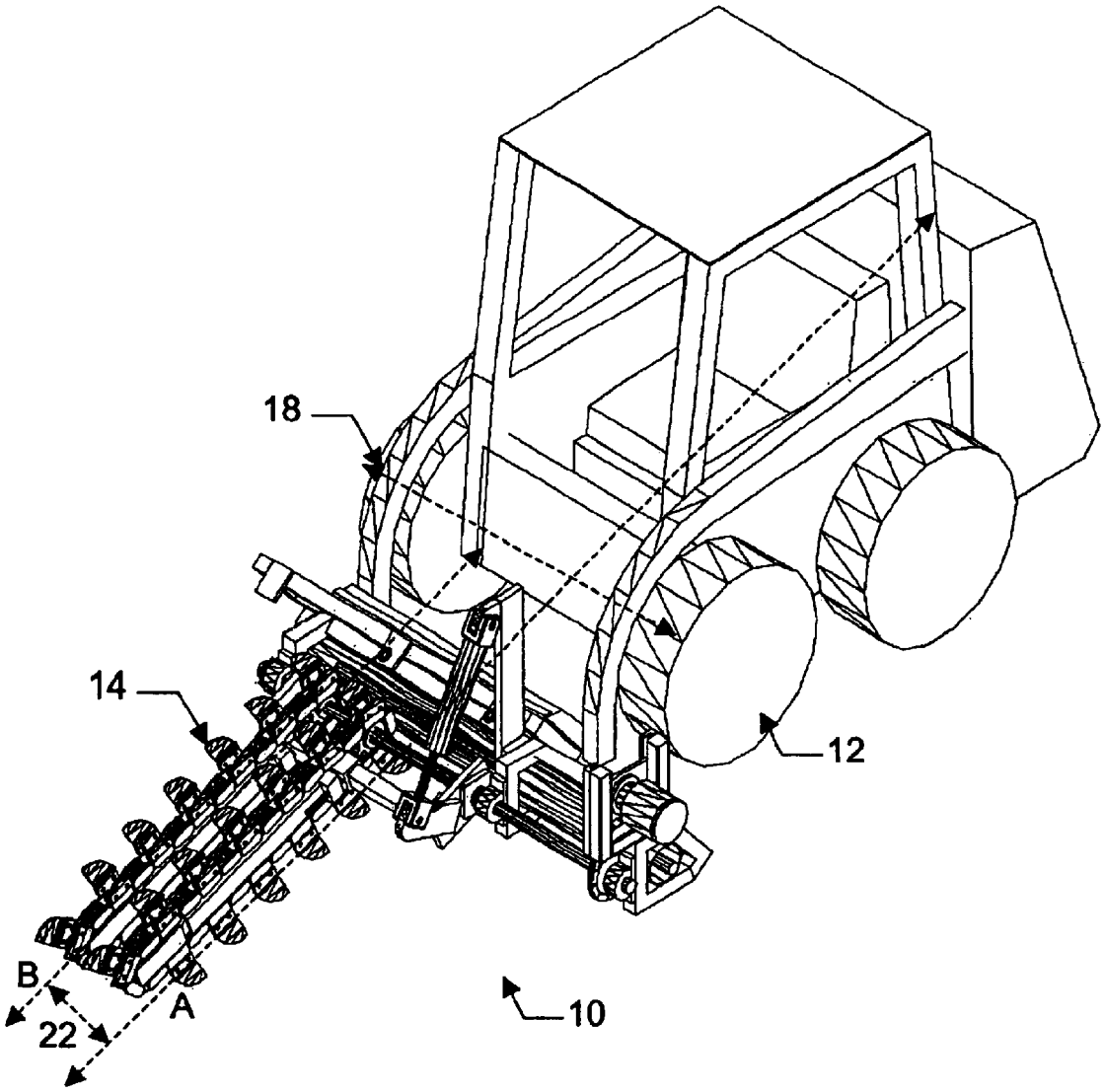

FIG. 2 is a perspective view of a trench-digging machine according to one embodiment of the present invention mounted on a transportation vehicle at a position within the widthwise boundary of the transportation vehicle.

Figure 3A:
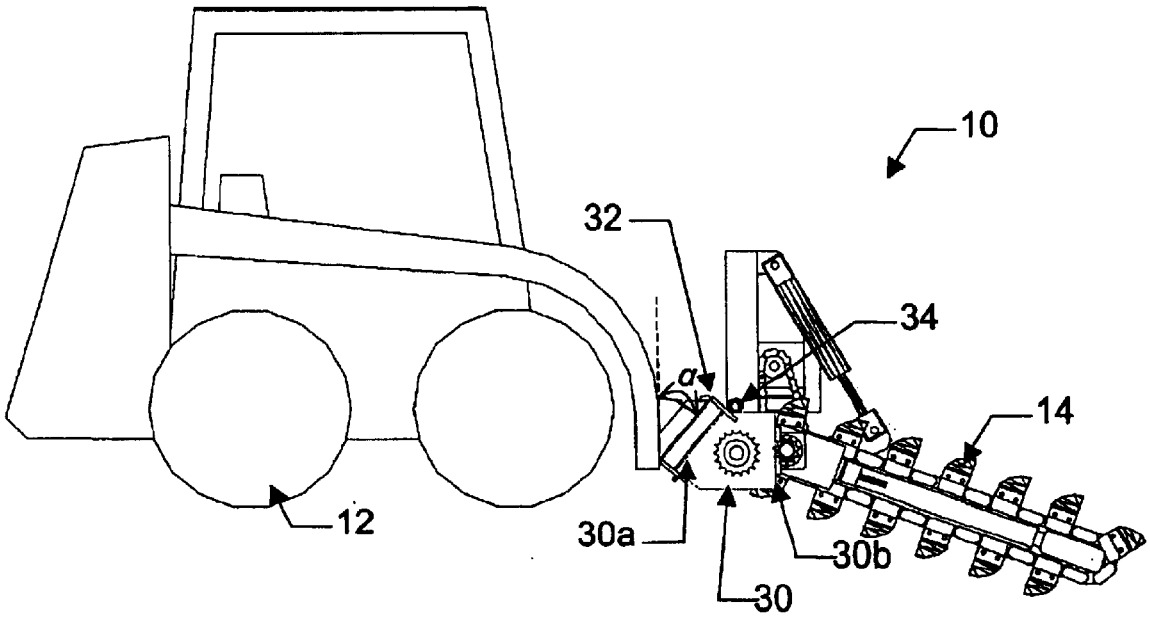

FIG. 3A is a side view of a trench-digging machine according to one embodiment of the present invention illustrating connection of the trench-digging machine to a transport machine.

Figure 3B:
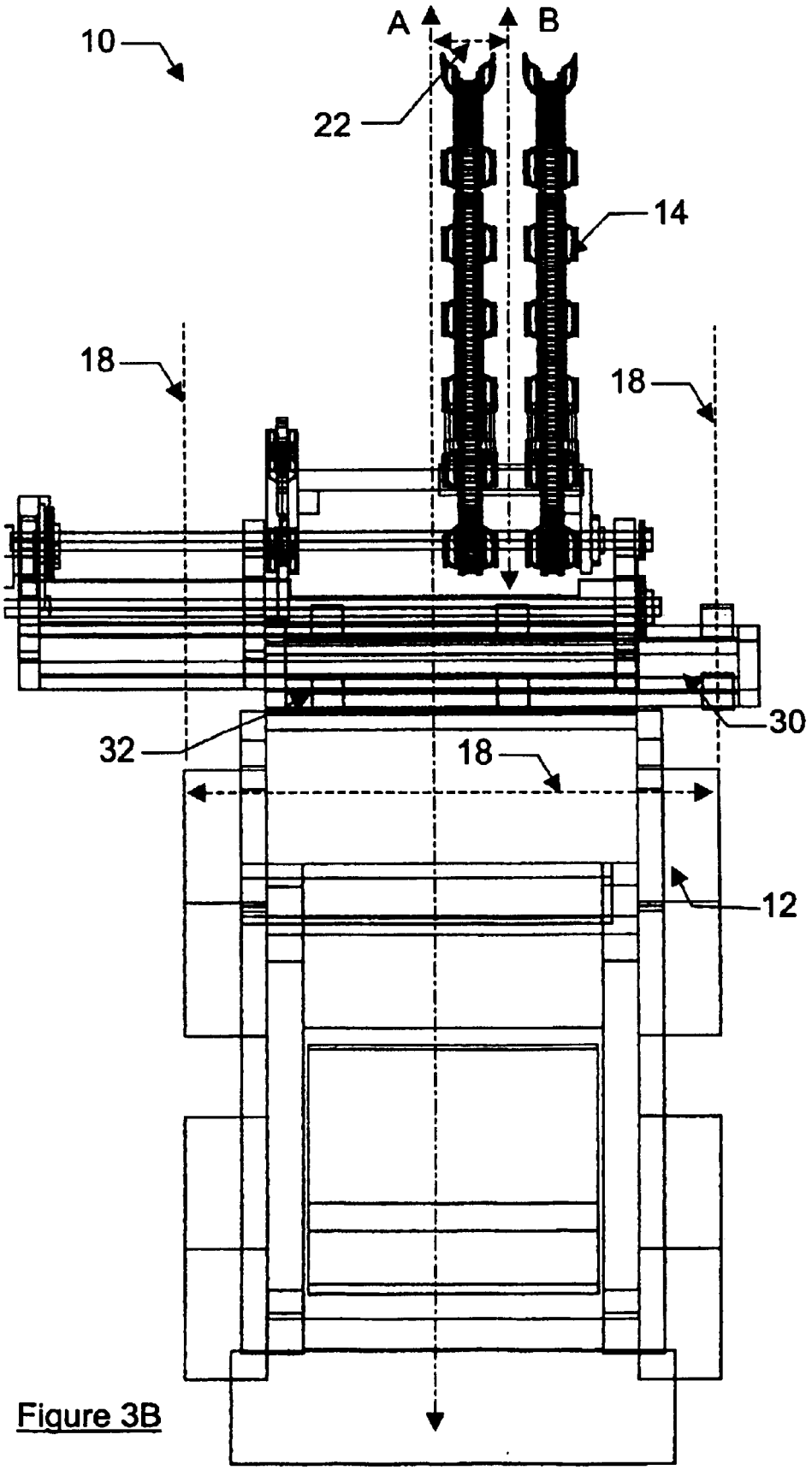

FIG. 3B is a top view of a trench-digging machine according to one embodiment of the present invention illustrating connection of the trench-digging machine to a transportation vehicle, where the digging implement is positioned within the widthwise boundary of the transportation vehicle.

Figure 3C:
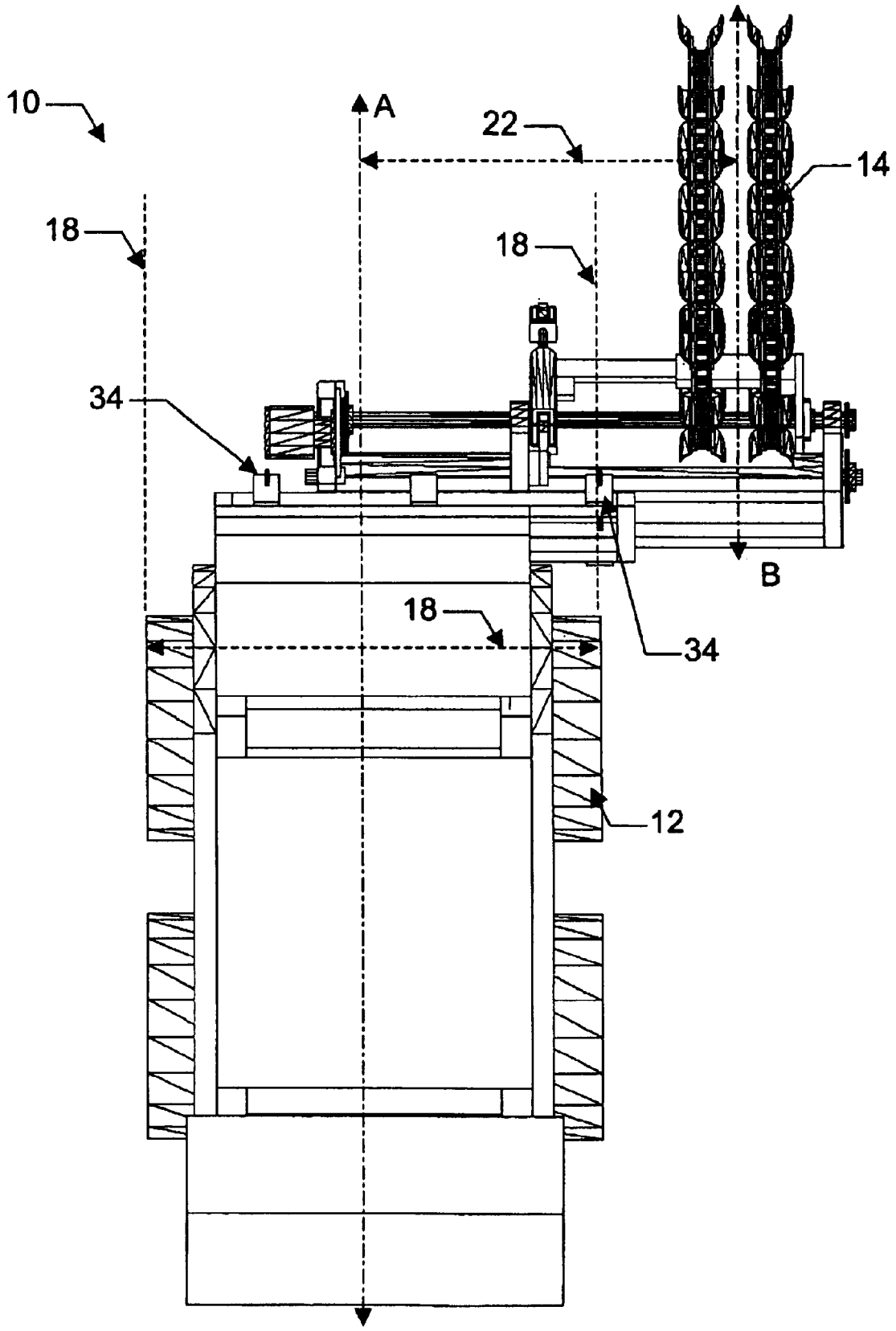

FIG. 3C is a top view of a trench-digging machine according to one embodiment of the present invention illustrating connection of the trench-digging machine to a transportation vehicle, where the digging implement is positioned at an offset from the widthwise boundary of the transportation vehicle for digging a trench adjacent to the transportation vehicle.

Figure 4A:
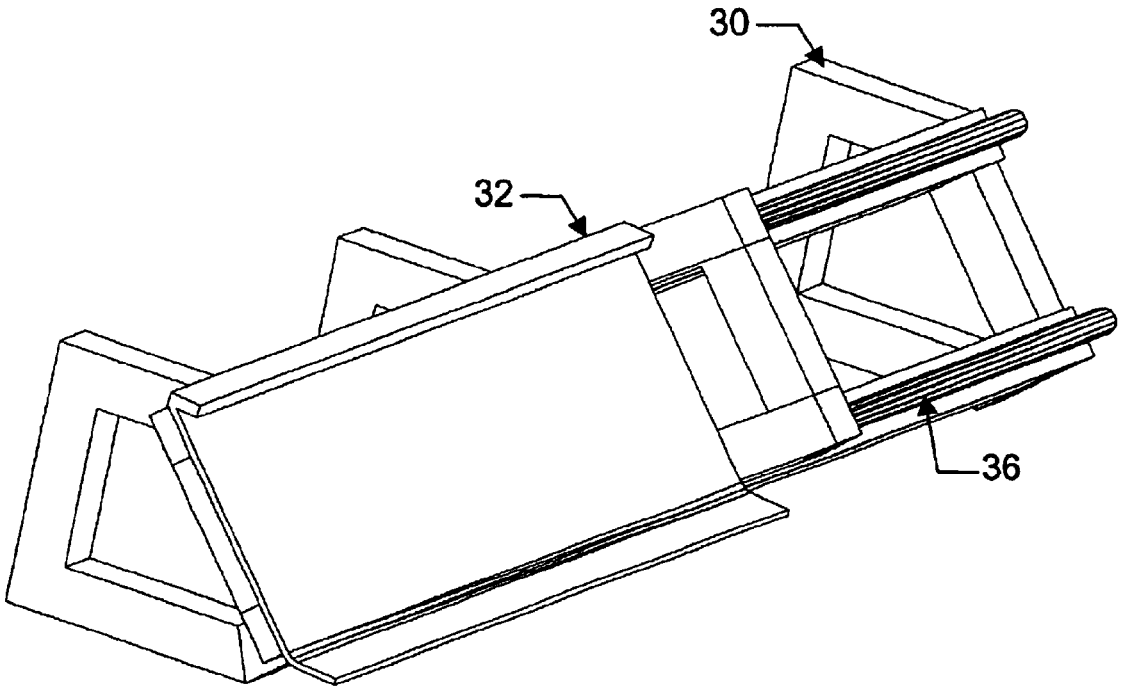

FIG. 4A is a perspective view of an embodiment of the present invention in which the frame and attachment are slideably connected to each other.

Figure 4B:
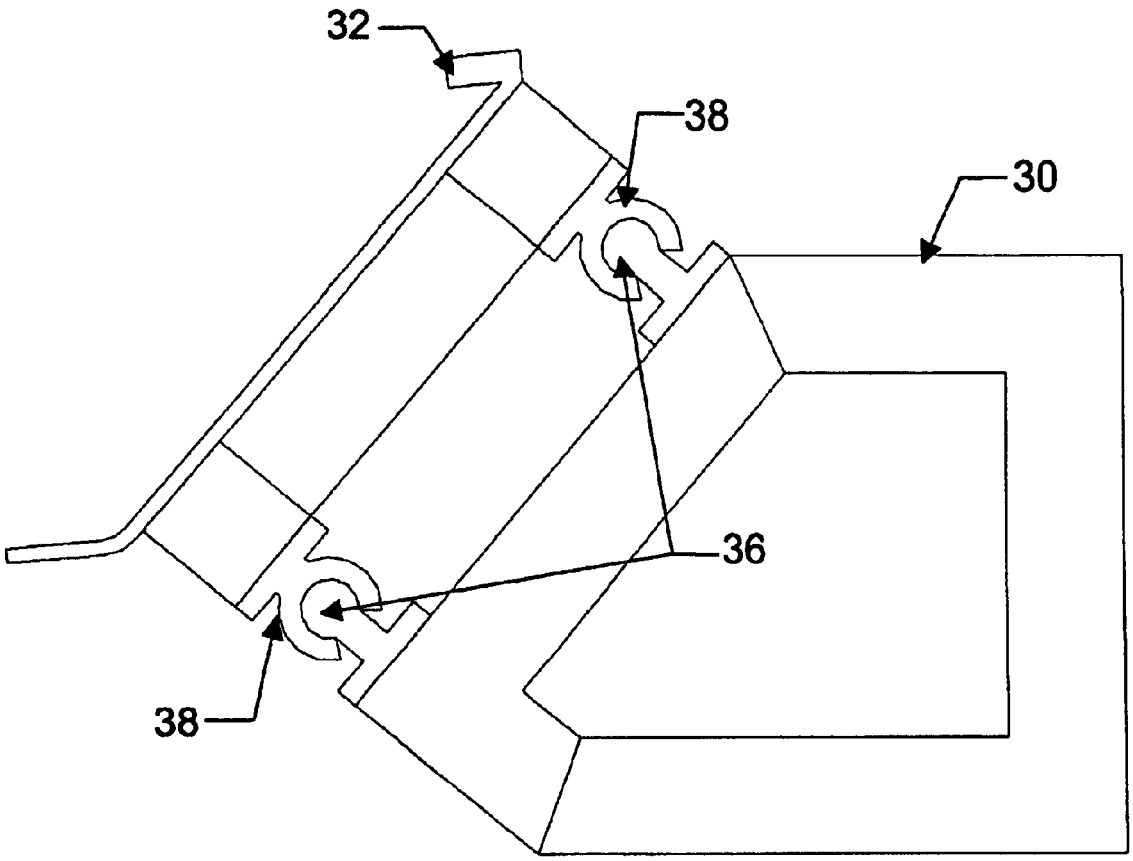

FIG. 4B is a cross-sectional view of the frame and attachment plate of FIG. 4A.

Figure 5:
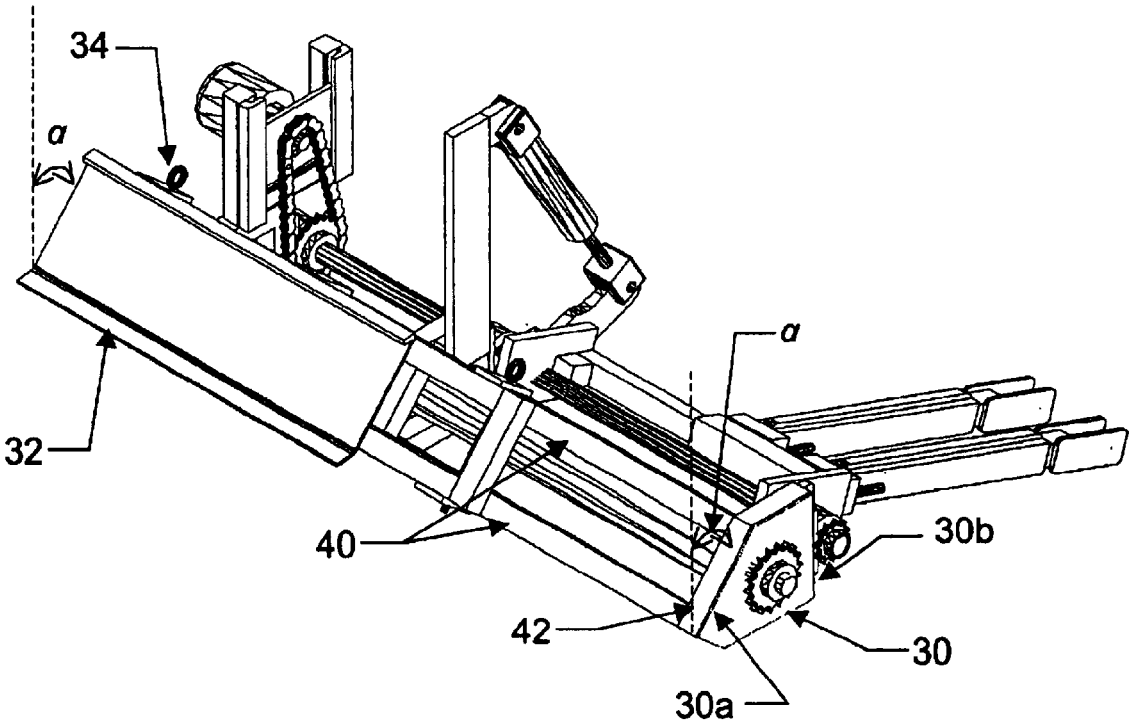

FIG. 5 is a perspective view of the trench-digging machine of one embodiment of the present invention having an attachment plate angled downward to create a low profile digging machine.

Figure 6:
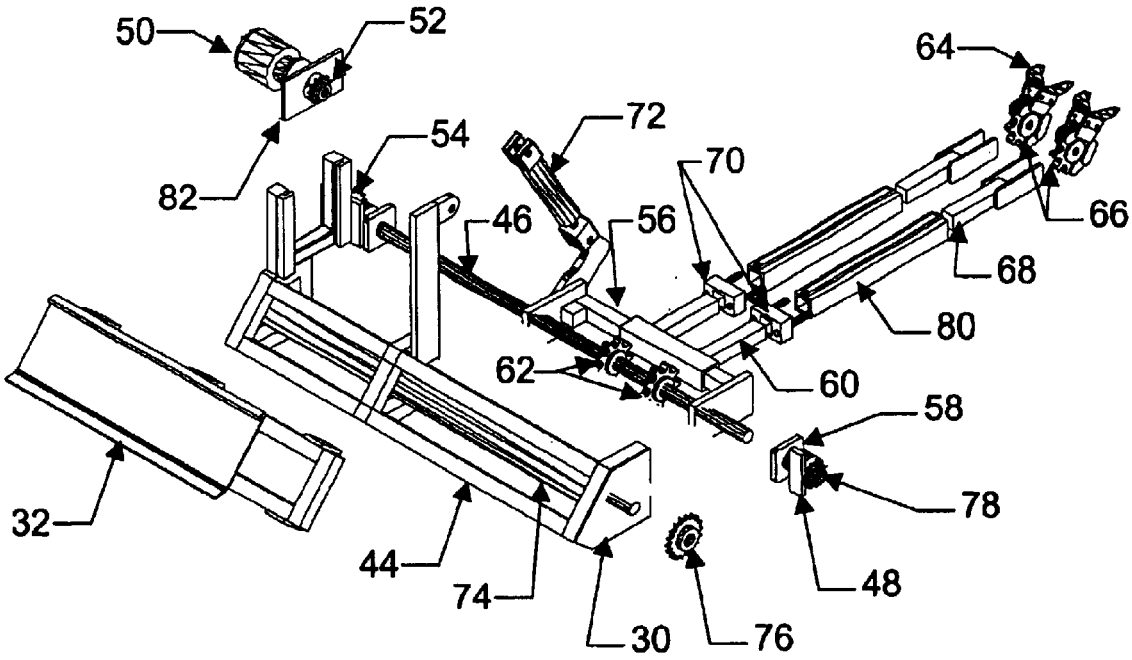

FIG. 6 is an exploded view of a chain-digging machine in which the machine of the present invention is implemented in one embodiment.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As described in greater detail below, the present invention provides trench-digging machinery capable of digging trenches under or adjacent to existing structures. Specifically, the present invention provides trench-digging machinery having an attachment plate for connecting a trench-digging element to a transport machine. The attachment plate is carried by the transport machine and is configurable with regard to the frame of the digging implement, such that the digging implement can be configured laterally with respect to the lengthwise extending axis of the transport machine. The digging implement may be placed at a lateral position that is outside the widthwise, lateral bounding planes of the transport machine. In this position, the digging implement can be positioned under an existing structure for digging, while the transport machine is located adjacent to the existing structure. A similar orientation may also be used to dig adjacent to an existing structure.

More specifically, FIG. 1 illustrates a perspective view of one embodiment of the trench-digging machine 10 of the present invention connected to a transport machine 12. As illustrated, the digging implement 14 of the trench-digging machine is positioned under an existing structure 16. Importantly, the centerline B of the digging implement 14 is positioned at a lateral offset from the lengthwise extending axis A of the transport machine 12, such that the digging implement is positioned outside the widthwise, lateral bounding planes 18 of the transport machine 12. In this position, the digging implement 14 can dig a trench 28 underneath the structure 16, while the transport machine travels adjacent to an outer boundary 20 of the existing structure.

Although the advantages of the trench-digging machine of the present invention are realized by configuration of the digging implement at a lateral position beyond the widthwise, lateral bounding planes 18 of the transport machine, it must be understood that the digging implement 14 of the present invention may be placed at any one of several offset positions relative to the lengthwise extending axis A of the transport machine 12. For example, FIG. 2 provides an illustration of the trench-digging machine where the digging implement is positioned at an offset 22 with respect to the lengthwise extending axis A of the transport machine such that the trench-digging implement is within the widthwise, lateral bounding planes 18 of the transportation vehicle 12. In this position, the digging implement may dig a trench within the widthwise, lateral bounding planes of the transport machine. More importantly, however, this configuration of the trench-digging machine of the present invention is a more compact configuration of the trench-digging machine used for transporting the machine from job site to job site.

With reference to FIG. 1, the present invention also provides a trench-digging machine 10 having a low profile 24 with respect to the transportation vehicle 12. This low profile of the trench-digging element of the present invention provides a clearance that is less than the clearance 26 of the existing structure 16, such that the digging implement may be inserted under the existing structure for digging a trench 28.

The above advantages of the present invention as illustrated in FIGS. 1 and 2 are more specifically discussed below with regard to various implementations of the present invention. The discussion below illustrates the present invention in conjunction with chain-driven, trench-digging machines. It must be understood that the present invention may be used in any particular trench-digging machine design without straying from the concepts presented herein. Importantly, the present invention provides structures that can be used with any trench-digging machine to allow the machine to operate at an extended offset from the transport machine and at a low profile. Further, the figures illustrate the present invention connected to a skid-steer loader, however, it must be understood that any transport machine may be used such as tractor, etc.

FIGS. 3A–3C more specifically illustrate the advantages of the present invention. As illustrated, the trench-digging machine 10 of the present invention includes a digging implement 14 that is used to dig trenches into the earth. The digging implement is connected to a frame 30, which supports the digging implement and maneuvers the digging implement into a downward position for digging and an upward position for transport of the digging implement. Importantly, connecting the frame 30 of the trench-digging machine of the present invention to a transport machine 12 is an attachment plate 32. The attachment plate 32 includes connecting pins 34 for connecting the attachment plate to the frame of the transport machine. These pins pass through aligned holes, not shown, resident in both the frame and attachment plate.

Importantly, the frame 30 of the present invention includes holes at least two different locations on the frame, and typically at several locations along the frame. The position of the holes is selected so as to provide different offset positions between the lengthwise extending axis A of the transport machine and the centerline B of the digging implement 14. By removing the pins 34 and repositioning the attachment plate laterally along the frame 30 to a different set of holes in the frame and then connecting the attachment plate to the transport machine 12, the offset between the lengthwise extending axis A of the transport machine and the centerline B of the digging implement 14 can be altered. For example, FIG. 3B illustrates a top view of the digging implement in one orientation relative to the transport machine. As illustrated, the pins 34 connect the attachment plate 32 and frame 30 in an orientation that places the digging implement 14 at an offset 22, which is within the widthwise, lateral bounding planes 18 of the transport machine 12. In this configuration, the trench-digging machine of the present invention may be used to dig trenches within the boundaries of the transport machine, similar to a more conventional trench-digging machine.

However, as discussed, an important advantage of the present invention is the ability to dig trenches at different offsets of the centerline B of the digging implement from the lengthwise axis A of the transport machine. It is especially advantageous to offset the digging implement outside the widthwise, lateral bounding planes 18 of the transport machine 12, such that the trench-digging machine of the present invention may be used to dig trenches either under or adjacent to existing structures. For example, FIG. 3C illustrates an orientation of the digging implement 14 of the present invention outside the widthwise, lateral bounding planes 18 of the transport machine 12. In this instance, the pins 34 connecting the attachment plate 32 to the frame 30 of the trench-digging machine have been removed, the attachment plate 32 positioned at new position on the frame 30, and the pins replaced in holes in the frame located at the new position. Although only two positions are illustrated, it is understood that the plate and frame may be connected at any offset.

In the embodiment illustrated in FIGS. 3A–3C, the attachment plate and frame are manually oriented with respect to each other by removal of pins 34, repositioning of the attachment plate 32 with respect to the frame 30, and reinserting the pins. In this embodiment, the attachment plate 32 typically has to be removed from the transport machine 32 prior to reconfiguration. In some embodiments, however, it may be advantageous to create a slideable connection between the attachment plate and frame, such that the attachment plate 32 does not have to be removed from the transport machine 12 to alter the offset between the digging implement 14 and the transport machine 12.

For example, FIGS. 4A and 4B illustrate an embodiment of the present invention in which the attachment plate 32 and frame 30 of the present invention are slideably connected to each other. In this embodiment, the frame 30 includes rails 36 that are inserted into guides 38 resident on the attachment plate 32. The rails and guides are slideable with respect to each other, thereby allowing the plate and frame to slide relative to each other. In this embodiment of the present invention, the attachment plate 32 does not have to first be removed from the transport machine 12 before reconfiguring the digging implement relative to the lengthwise axis A of the transport machine. Instead, the frame of the digging machine may be merely slid relative to the plate to a new offset position.

Although not illustrated, the embodiment in FIGS. 4A and 4B may include pins 34 that lock the attachment plate and frame in selected positions relative to each other, as with the embodiment of FIGS. 3A–3B. Further, although the attachment plate and frame could be slid manually, the trench-digging machine of this embodiment could alternatively include a system for controllably sliding the attachment plate and frame relative to each other. For example, the trench-digging machine of this embodiment could include a hydraulic cylinder having one end connected to the frame and another to the attachment plate. The hydraulic cylinder can control the lateral offset between the centerline of the digging implement and the lengthwise extending axis A of the transport machine by moving the attachment plate and frame relative to each other. Devices other than a hydraulic cylinder are contemplated for controllably moving the frame and attachment plate.

As an alternative to the embodiment illustrated in FIGS. 4A and 4B, the frame 30 of the present invention could instead include a series of laterally, telescoping tubes. The offset between the digging implement 14 and transport machine 12 can be altered in this embodiment by extending or detracting the tubes.

In addition to allowing the digging implement 14 of the present invention to be offset with respect to the lengthwise axis A of the transport machine 12, the trench-digging machine of the present invention also provides a low profile configuration of the digging implement. Specifically, a skid-steer loader, tractor, or other transport machine to which the trench-digging machine may be attached may have a minimum range of motion for moving the trench-digging machine downwardly toward the ground. For instance, some of these machines may have a downward range minimum that results in a clearance of 6 inches or more between the attachment of the plate to the transport machine and the ground.

With reference to FIGS. 3A and 5, to remedy this problem, in some embodiments of the present invention, the plate 32 may be oriented at an angle α offset from vertical such that the attachment plate faces downwardly. In order to mate with the plate 32, the frame 30 may be configured to extend between a first face 30*a* that is connected to the plate 32 and oriented at the same angle α offset from vertical as the plate. Further, the frame of this embodiment may include an opposed second face 30*b* having a vertical orientation. Thus, the digging implement may be connected to the second face of the frame so as to be connected to a surface having the desired vertical orientation. However, by operably connecting the frame to the transport machine by means of a plate that faces downwardly, the digging implement is connected to the frame at a position closer to the ground. As a result, the trench-digging machine of this embodiment requires less clearance so as to effectively reduce the distance by which a structure must be raised above the ground in order to permit the trench to be dug thereunder.

This configuration of the attachment plate 32 may also aid in strengthening the frame 30. Specifically, the frame 30 of the trench-digging machine is constructed in such a way as to provide strength while having a very low profile. The overall height is held to a minimum to allow the trencher unit to dig underneath the existing structure. If the attachment plate 32 were to extend vertically downward, the main frame must have an increased height in order to provide strength. This increased height affects the minimum profile of the trench-digging machine. However, because the attachment plate 32 is positioned at an offset angle α from vertical in the range of 20 to 60 degrees and preferably 45 degrees, the frame can be strengthened. Specifically, in this embodiment, the first face 30*a* of the frame includes a pair of widthwise extending rails 40 and at least one strut 42 extending between the pair of rails to provide strength and rigidity. The attachment plate may therefore be connected to the at least one strut. As a result, the at least one strut of the frame also preferably extends to the same angle offset α from vertical as the attachment plate. By extending at an angle from vertical, the strut 42 is generally somewhat longer than conventional vertical struts, thereby advantageously increasing the strength of the frame.

As illustrated in the above embodiments, the trench-digging machine 10 of the present invention is discussed in relation to a chain-digging system. It is understood that the concepts of the present invention apply to any trench-digging machine, however. To fully explain the implementation of the present invention, provided below with reference to FIG. 6 is a listing of the various parts of the chain-digging system in which the invention is implemented.

Specifically, as illustrated, the trench-digging machine of this embodiment, includes an attachment plate 32 for connecting the machine to a transport machine 12. The attachment plate has many various configurations to accommodate attachment to skid-steer loaders, tractor front-end-loaders, and tractor 3-point hitches. The frame 30 of the present invention includes a main frame support 44 to which other components of the assembly are attached. The main frame is constructed in such a way as to provide strength while having a very low profile. The overall height is held to a minimum to allow the trencher unit to dig underneath the perimeter of an existing structure. A main shaft 46 runs the entire width of the trench-digging machine and is attached to the main frame by means of pillow block bearing units 48.

A hydraulic motor 50 provides rotational power for the trench-digging machine by means of the hydraulic supply of the machine to which it is attached. The hydraulic motor is connected to the main shaft by means of a roller chain and sprocket arrangement, (52 and 54).

The boom frame 56 is attached to the main shaft by means of flange mount pillow block bearing units 58. This allows the boom frame 56 to remain in a fixed location on the main shaft while the main shaft rotates, and the boom frame can also be rotated on the main shaft. The boom frame has a square member that permits the attachment of boom posts 60. The boom post is attached to the boom frame by mating a slightly larger square member over the boom frame square member so that lateral adjustment is possible. The boom post has one or more square members projecting outward to receive one or more digging chain assemblies. The boom post can be moved laterally manually, by a jack screw arrangement, or hydraulically if desired. member over the boom frame square member so that lateral adjustment is possible. The boom post has 1 or more square members projecting outward to receive 1 or more digging chain assemblies. The boom post can be moved laterally manually, by ajack screw arrangement, or hydraulically if desired.

A head sprocket 62 slides on the main shaft by means of a key and keyway and transmits rotational motion to the digging chain 64. The location of the head sprocket(s) match the location of the boom post and is (are) held in location by means of a set screw. A nose sprocket 66 is mounted between the flanges sprocket yoke 68 to permit idle rotation with the digging chain. A chain adjuster 70 is a jack screw arrangement that increases the effective length of the digging boom and thereby tightens the digging chain.

The depth of cut of the trencher unit is controlled by a hydraulic cylinder 72 that has one end attached to the main frame and the other is attached to the boom frame so that when the cylinder is extended, the boom frame and digging chain assembly is rotated downward and when the cylinder is retracted the assembly is raised to a shallower depth of cut. The hydraulic cylinder is also powered by the hydraulic system of the machine.

Optionally a dirt removal auger 74 can be positioned in front of the digging chain in the direction of travel so that as loose dirt is brought out of the ground the auger can carry the dirt laterally away from the trench being dug. This dirt removal auger can be driven by a hydraulic motor or by a roller chain and sprocket arrangement being driven by the main shaft. An auger sprocket 76 is mounted on the auger's shaft by means of a key and keyway and is driven by roller chain by the main shaft. Further, an auger drive sprocket 78 is mounted on the main shaft by key and keyway and rotates with the main shaft driving the auger shaft.

The pillow block bearing 48 units are used to mount the main shaft to the main frame. Flange mount pillow block bearing 58 units are used to mount the boom frame to the main shaft.

The boom tube 80 is the main frame of the digging boom. The boom tube is a square member that slides over the square member of the boom post and then receives the square member of the sprocket yoke on the other end. The boom tube has a wear bar on the top and bottom sides to guide the digging chain. The sprocket yoke 68 slides into the square member of the boom tube and also receives the nose sprocket between the flanges of its yoke.

A motor mounting plate 82 is bolted to the hydraulic motor and slides into a groove or channel in the main frame to mount the hydraulic motor and is equipped with jack screws to permit the adjustment of a roller chain that drives the main shaft. Main drive sprocket 52 is mounted on the hydraulic motor by key and keyway and drives a roller chain that, in turn, drives the main shaft. Main drive sprocket 54 is mounted on the main shaft by key and keyway and is driven by roller chain by the hydraulic motor to impart rotation to the main shaft.

The digging chain 64 rides on and is driven by the head sprocket and runs across the wear bar of the boom tube and continues around the nose sprocket and back. The digging chain provides the cutting action of the soil and also moves the loose soil out of the trench being dug.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A trench-digging machine for digging a trench under a structure comprising:

a frame for operable connection to a transport machine, wherein the transport machine defines a lengthwise extending axis and extends widthwise between a pair of lateral bounding planes;

a digging implement connected to the frame for digging the trench, wherein the frame is connected to the transport machine such that a center-line of the digging implement is capable of being laterally offset from the lengthwise extending axis to a position beyond the respective lateral bounding planes, thereby permitting the digging implement to be placed under the structure; and an attachment plate carried by the transport machine and capable of connecting said frame to the transport machine wherein said attachment plate is oriented at a permanently fixed angle offset from vertical such that said attachment plate faces downwardly at a fixed position.

2. A trench-digging machine according to claim 1 wherein said attachment plate is capable of connecting said frame to the transport machine at a plurality of predetermined positions such that the center-line of said digging implement carried by said frame is adjustable with respect to the lengthwise extending axis of the transport machine by connecting the frame to the transport machine at different predetermined positions.

3. A trench-digging machine for digging a trench under a structure comprising:

a frame for operable connection to a transport machine, wherein the transport machine defines a lengthwise extending axis and extends widthwise between a pair of lateral bounding planes;

a digging implement connected to the frame for digging the trench, wherein the frame is connected to the transport machine such that a center-line of the digging implement is capable of being laterally offset from the lengthwise extending axis to a position beyond the respective lateral bounding planes, thereby permitting the digging implement to be placed under the structure; and an attachment plate carried by the transport machine and capable of connecting said frame to the transport machine at a plurality of predetermined positions such that the center-line of said digging implement carried by said frame is adjustable with respect to the lengthwise extending axis of the transport machine by connecting the frame to the transport machine at different predetermined positions, wherein said attachment plate is oriented at an angle offset from vertical such that said attachment plate faces downwardly and wherein said frame comprises a pair of widthwise extending rails and at least one strut extending between said pair of rails, and wherein said attachment plate is connected to said at least one strut of said frame.

4. A trench-digging machine according to claim 3, wherein said at least one strut of said frame also extends at substantially the same angle offset from vertical as said attachment plate.

5. A trench-digging machine for digging a trench under a structure comprising:

a frame for operable connection to a transport machine, wherein the transport machine defines a lengthwise extending axis and extends widthwise between a pair of lateral bounding planes;

a digging implement connected to the frame for digging the trench, wherein the frame is connected to the transport machine such that a center-line of the digging implement is capable at being laterally offset from the lengthwise extending axis to a position beyond the respective lateral bounding planes, thereby permitting the digging implement to be placed under the structure; and an attachment plate, carried by the transport machine and capable of connecting said frame to the transport machine at a plurality of predetermined positions such that the center-line of said digging implement carried by said frame is adjustable with respect to the lengthwise extending axis of the transport machine by connecting the frame to the transport machine at different predetermined positions, wherein said attachment plate is oriented at an angle offset from vertical such that said attachment plate faces downwardly and wherein said frame comprises a pair of widthwise extending rails and at least one strut extending between said pair of rails, and wherein said attachment plate is connected to said at least one strut of said frame, wherein said at least one strut of said frame also extends at substantially the same angle offset from vertical as said attachment plate, and wherein said frame is configured to extend between a first face comprised of said pair of rails and said at least one strut that is oriented at substantially the same angle offset from vertical as said attachment plate and an opposed second face having a substantially vertical orientation and to which said digging implement is connected.

6. A trench-digging machine comprising:

an attachment plate for operable connection to a transport machine which defines a vertical axis, wherein said attachment plate is oriented at an angle offset from vertical such that said attachment plate faces downwardly;

a frame connected to said attachment plate; and a digging implement connected to the frame for digging the trench, wherein said frame is configured to extend between a first face connected to said attachment plate and oriented at substantially the same angle offset from vertical as said attachment plate and an opposed second face having a substantially vertical orientation and to which said digging implement is connected.

7. A trench-digging machine according to claim 6, wherein the first face of said frame comprises a pair of widthwise extending rails and at least one strut extending between said pair of rails, and wherein said attachment plate is connected to said at least one strut of said frame.

8. A trench-digging machine according to claim 7, wherein said at least one strut of said frame also extends at substantially the same angle offset from vertical as said attachment plate.

9. A trench-digging machine according to claim 6, wherein the transport machine defines a lengthwise extending axis and extends widthwise between a pair of lateral bounding planes, and wherein said frame is connected to the transport machine such that a center-line of the digging implement is capable of being laterally offset from the lengthwise extending axis to a position beyond the respective lateral bounding plane, thereby permitting the digging implement to be placed under the structure.

10. A trench-digging machine according to claim 9 wherein said attachment plate is capable of connecting said frame to the transport machine at a plurality of predetermined positions such that the center-line of said digging implement carried by said frame is adjustable with respect to the lengthwise extending axis of the transport machine by connecting the frame to the transport machine at different predetermined positions.

11. A trench-digging machine comprising:

an attachment plate for operable connection to a transport machine which defines a vertical axis, wherein said attachment plate is oriented at an angle offset from vertical such that said attachment plate faces downwardly;

a frame comprising a pair of widthwise extending rails and at least one strut extending between said pair of rails, said frame configured to extend between a first face, comprising said pair of rails and said at least one strut, that is connected to said attachment plate and oriented at substantially the same angle offset from vertical as said attachment plate and an opposed second face having a substantially vertical orientation; and a digging implement connected to the second face of said frame for digging the trench.

12. A trench-digging machine according to claim 11 wherein the transport machine defines a lengthwise extending axis and extends widthwise between a pair of lateral bounding planes, and wherein said frame is connected to the transport machine such that a center-line of the digging implement is capable of being laterally offset from the lengthwise extending axis to a position beyond the respective lateral bounding plane, thereby permitting the digging implement to be placed under the structure.

13. A trench-digging machine according to claim 12 wherein said attachment plate is capable of connecting said frame to the transport machine at a plurality of predetermined positions such that the center-line of said digging implement carried by said frame is adjustable with respect to the lengthwise extending axis of the transport machine by connecting the frame to the transport machine at different predetermined positions.

* * * * *